US006442878B1

(12) United States Patent
Letterio

(10) Patent No.: US 6,442,878 B1
(45) Date of Patent: Sep. 3, 2002

(54) CARD STORAGE AND DISPLAY DEVICE AND METHOD OF USE

(76) Inventor: John E. Letterio, 23 O St., Hull, MA (US) 02045

( * ) Notice: Subject to any disclaimer, the term of this patent is extended or adjusted under 35 U.S.C. 154(b) by 0 days.

(21) Appl. No.: 09/888,016

(22) Filed: Jun. 25, 2001

(51) Int. Cl.[7] ..... G09F 1/10

(52) U.S. Cl. ..... 40/124.4; 211/55; 40/392

(58) Field of Search ..... 40/124, 124.4, 40/391, 392–393, 405, 532, 124.7, 534, 536, 341, 649, 651; 211/45, 50, 55, 72

(56) References Cited

U.S. PATENT DOCUMENTS 2,234,395 A * 3/1941 Bauder ..... 40/124.4
2,959,879 A * 11/1960 Mazur ..... 40/405
4,263,735 A * 4/1981 Miller et al. ..... 40/391
5,393,157 A * 2/1995 Basmajiam ..... 402/79

* cited by examiner

*Primary Examiner*—Cassandra H. Davis
(74) *Attorney, Agent, or Firm*—Timothy Thut Tyson; Ted Masters; Freilich, Hornbaker & Rosen

(57) ABSTRACT

A card storage and display device (20) includes a first sheet (22) which is attached to a second sheet (36). A first sheet (22) has a plurality of parallel slits (24) which are arranged in stair step fashion. First sheet (22) also has a corresponding plurality of tabs (32), also arranged in stair step fashion, wherein each slit (24) has an accompanying tab (32). The second sheet (36) has a plurality of openings (38) which align with and accept tabs (32) when first sheet (22) is placed on top of second sheet (36). When a card (500) is inserted in a slit (24), the lower corner (501) of card (500) abuts tab (32) and thus prevents further insertion of card (500) into slit (24). Resultantly, a portion of card (500) remains displayed to a user.

8 Claims, 7 Drawing Sheets

CARD STORAGE AND DISPLAY DEVICE AND METHOD OF USE

TECHNICAL FIELD

The present invention pertains generally to the organization of cards that contain various forms of information, and more particularly to a card storage and display device where a plurality of cards are held and displayed in a cascading relationship.

BACKGROUND ART

Devices for retaining and displaying cards such as conventional 3" by 5" index cards and business cards are well known in the art. For example, U.S. Pat. No. 4,056,894 shows a novel card file of a substantially rigid sheet having a plurality of parallel tandem slits. The length of the slits is slightly less than the length of the cards. Standard index cards without notches or cut-outs, are inserted, lined up parallel into the slits, and pressed into place providing a flippable card file.

U.S. Pat. No. 4,713,901 illustrates a file-index card system for retaining and displaying conventional business cards. The system's frame of planar sheets holds a multiplicity of file cards. Each file card has an area of adhesive covering a portion thereof, with a protective peel-off covering over the area of adhesive. Registration markings are provided on each file card to at least one side of the area of adhesive. The registration markings serve to delimit the edge of a conventional business card to be affixed to the file card. When in use, the protective peel-off covering removes to expose the adhesive. A conventional business card is aligned with the registration markings and affixes to the file card to be displayed.

U.S. Pat. No. 4,949,484 defines an improved system for retaining cards. A business card is placed in a card holder that permits the card to be stored in another card carrier that is small enough to fit in a coat pocket or purse. The business card can be removed from the card carrier and placed in a desk card holder such as a card file or rotary file without any need for physical alteration of the business card or transcription of the information from the business card to the filing card. The business card alternately can be removed from the desk card holder and placed in the card carrier, eliminating the necessity of transcribing the information from the card in the desk card holder to another card. The present invention relates to a novel housing member that retains the desk card holder and further relates to a novel card carrier that retains a series of card holders. The present invention also relates to business card holder that can be used in conjunction with conventional organizers and planners.

U.S. Pat. No. 5,335,435 discloses a media holder particularly suited for search and display of a selected media. The holder has a plurality of frames each configured to hold media (e.g. business cards, compact discs, computer diskettes) and pivotally mounted over a slidable striking member. The striking member contacts an abutment member defined by each frame to flip the frame for viewing.

DISCLOSURE OF INVENTION

The present invention is directed to a card storage and display device that can store and display a plurality of cards such as 3" by 5" cards and business cards. The cards are firmly held in place by a slit between two sheets, so that if the present invention is turned upside down, the cards will not fall out. The cards can conveniently be removed or repositioned in the card storage and display device, and the card storage and display device can be carried from location to location, or permanently mounted on a support surface such as a wall. The present invention can be used in a variety of applications, for example: to store and display sales information, time reminders, inventory lists, sports events or rankings, or bible verses. A preferred name for the present invention is Pro-Tracker.

Use as a Sales Tool

In one possible use, the present invention comprises a unique filing system that allows sales people to accurately keep track of their sales prospects and customers. Information pertaining to the sales prospect or customer is recorded on an index card. If the prospect requests a follow-up phone call on Tuesday, the card will be initially stored and displayed in the Tuesday device. The following Tuesday the salesperson would review the cards on the device labeled Tuesday and take appropriate action. However, if the customer then requests an additional phone call on Thursday, the index card will be moved to the Thursday card storage and display device.

The present invention allows the salesperson to keep notes pertaining to his or her prospects in one easy to find location. When a follow-up or appointment date is changed, there is no need to re-write the information about the prospect. Instead, the index card is simply moved to another card storage and display device.

A label that is printed or otherwise placed on the card storage and display device can be customized to coincide with the needs of the individual salesperson. For example in the insurance field, some labels might include: "In Underwriting", "Pending Delivery", "Outstanding Requirements", "Premium Due", etc. When it comes to Automobile sales, some labels might include; "Financing Needed", "Repair Open", "Vehicle Needed".

In accordance with a preferred embodiment of the invention, a card storage and display device includes a first sheet having a plurality of spaced apart parallel slits arranged in stair step cascading relationship. The first substantially planar sheet has a front side and an opposite back side. Each slit has a first end. A corresponding plurality of tabs are traversely spaced apart from each first end, the tabs outwardly projecting from the back side. A second substantially planar sheet has a corresponding plurality of openings, wherein the openings are disposed so that when the first sheet is placed on top of the second sheet and aligned therewith, the plurality of tabs occupy the corresponding plurality of openings.

In accordance with an important aspect of the invention, when a card having a lower corner is inserted into the slit, the lower corner of the card abuts the tab and is stopped thereby, so that a portion of the card remains outside the slit and in view of a user.

In accordance with an important feature of the invention, each tab is longitudinally aligned with each corresponding slit so that a card inserted into a next lower slit will not abut the tab.

In accordance with another important aspect of the invention, the first and second sheets are fabricated from semi-rigid material such as paper, cardboard, fiberboard, or a polymer.

In accordance with another important feature of the invention, the first and second sheets are permanently connected by either adhesive or a mechanical holder such as staples. A connection free area is provided to allow the card to slip between the two sheets.

Other features and advantages of the present invention will become apparent from the following detailed description, taken in conjunction with the accompanying drawings, which illustrate, by way of example, the principles of the invention.

MODES FOR CARRYING OUT THE INVENTION

Figure 1:
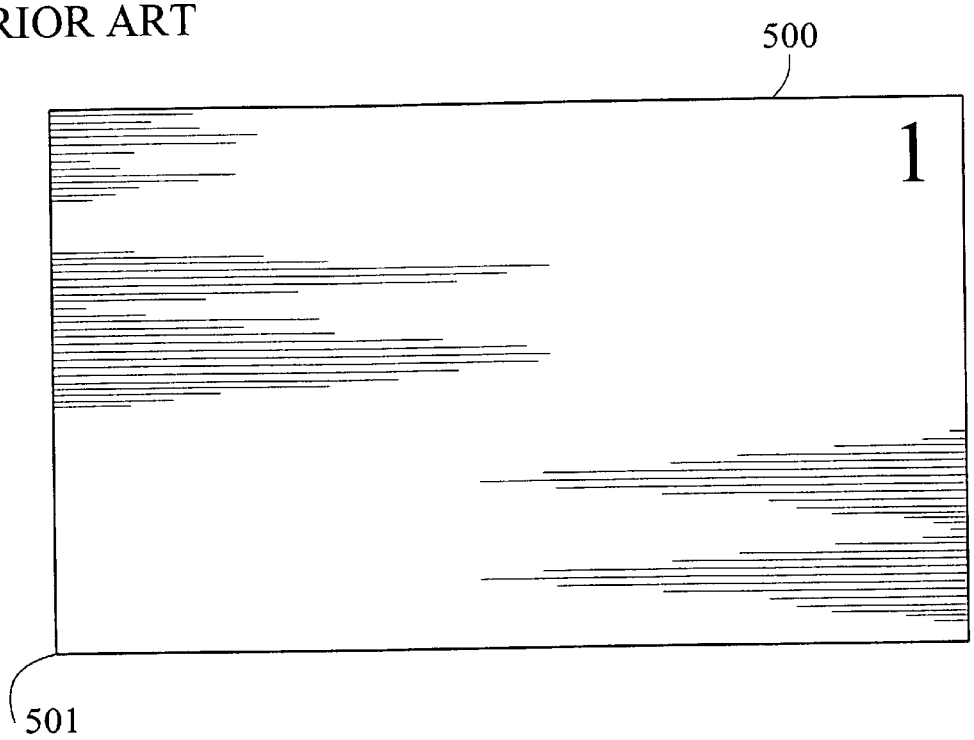
Fig. 1 PRIOR ART
FIG. 1 is an enlarged front elevation view of a card, such as a conventional 3" by 5" index card.
Figure 2:
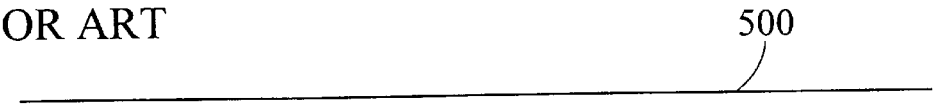
Fig. 2 PRIOR ART
FIG. 2 is an enlarged side elevation view of the card.

Referring initially to FIGS. 1 and 2, there are illustrated enlarged front and side elevation views respectively of a card, such as a conventional 3" by 5" index card or business card, or the like, generally designated as 500. Card 500 includes a lower corner 501. Card 500 typically comprises a thin planar sheet of paper or cardboard, upon which writing or other information is displayed.

Figure 3:
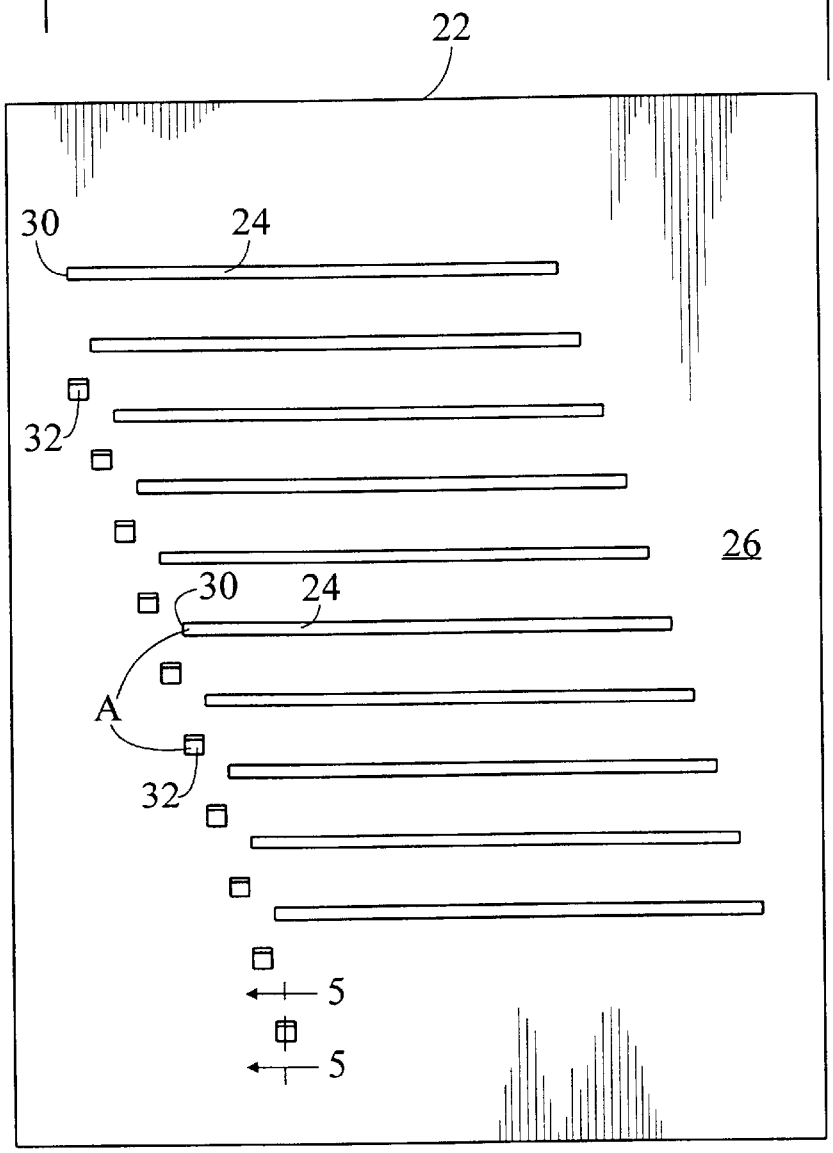
FIG. 3 is a front elevation view of a first sheet.
Figure 4:
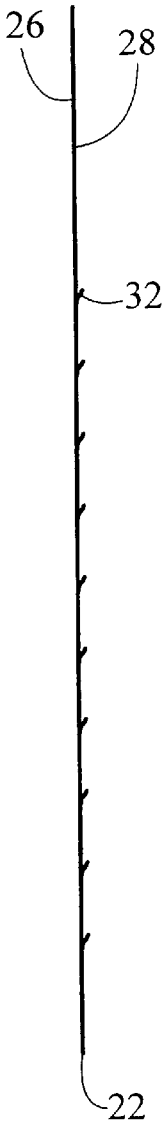
FIG. 4 is a side elevation view of the first sheet.

Now referring to FIGS. 3 and 4, there are illustrated front and side elevation views respectively of a card storage and display device in accordance with the present invention, generally designated as 20. Card storage and display device 20 includes a first sheet 22 having a plurality of spaced apart parallel slits 24 arranged in stair step relationship. That is, each slit 24 is longitudinally offset in the same direction from the preceding slit 24 to form a stair step or cascading pattern. First sheet 22 has a front side 26 and an opposite back side 28. Each slit 24 has a first end 30. First sheet 22 has a corresponding plurality of tabs 32 also arranged in stair step relationship. Each tab 32 cooperates with one slit 24 to form a slit/tab pair wherein tab 32 is disposed a predetermined distance below first end 30 of slit 24. For example, in FIG. 3, slit 24 and tab 32 combine to form slit/tab pair A. Tabs 32 outwardly project from back side 28.

Figure 5:
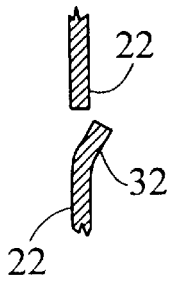
FIG. 5 is an enlarged cross-sectional view along the line 5—5 of FIG. 3.

FIG. 5 is an enlarged cross-sectional view along the line 5—5 of FIG. 3 showing tab 32 projecting from back side 28 of sheet 22.

Figure 6:
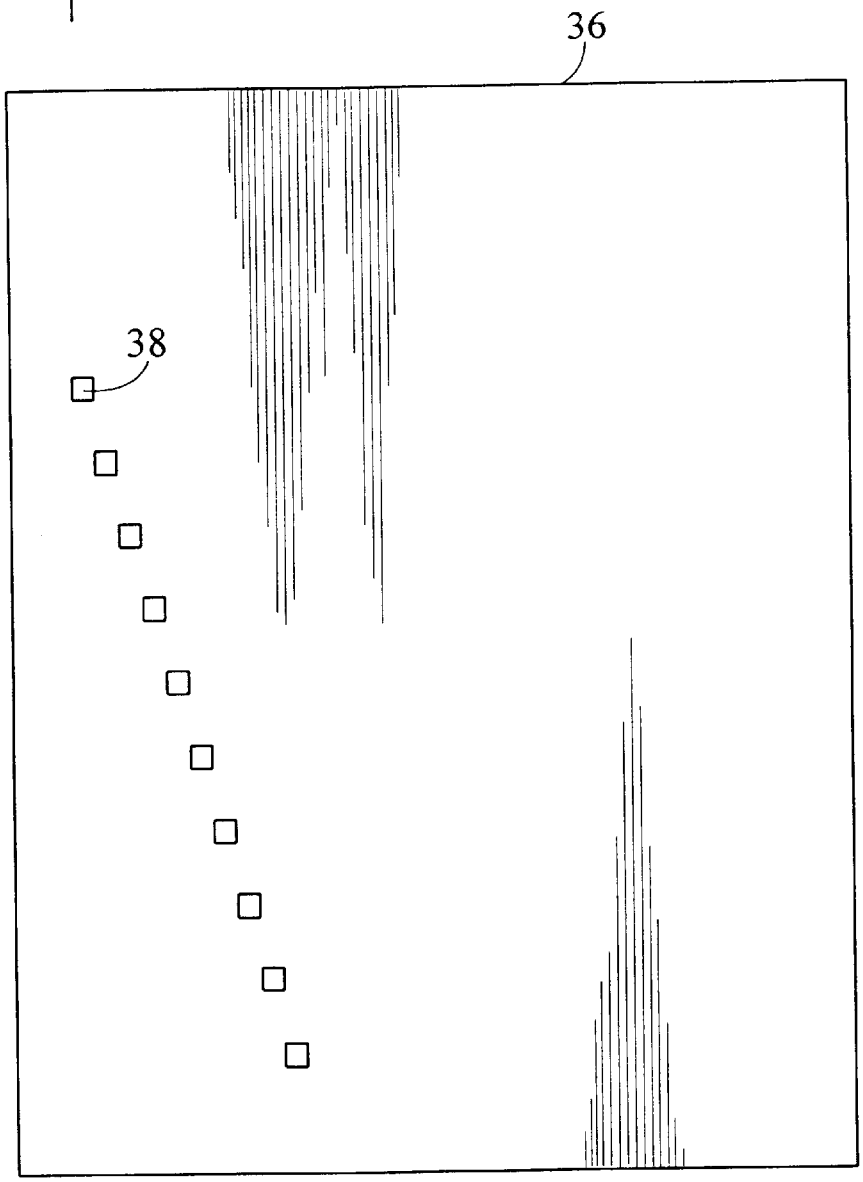
FIG. 6 is a front elevation view of a second sheet.
Figure 7:
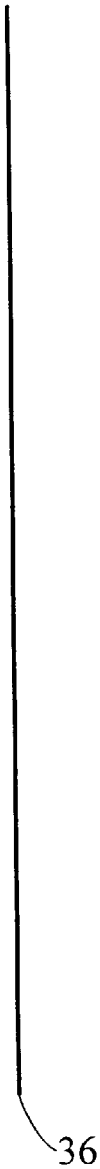
FIG. 7 is a side elevation view of the second sheet.

FIGS. 6 and 7 are front and side elevation views respectively of a second sheet 36. Second sheet 36 is the same size as first sheet 22, and has a corresponding plurality of openings 38 which receive tabs 32 of first sheet 22. Openings 38 are disposed so that when first sheet 22 is placed on top of second sheet 36 and aligned therewith, plurality of tabs 32 resided in corresponding plurality of openings 38. As may be seen from the figure, openings 38 have the same stair step alignment as tabs 32.

Figure 8:
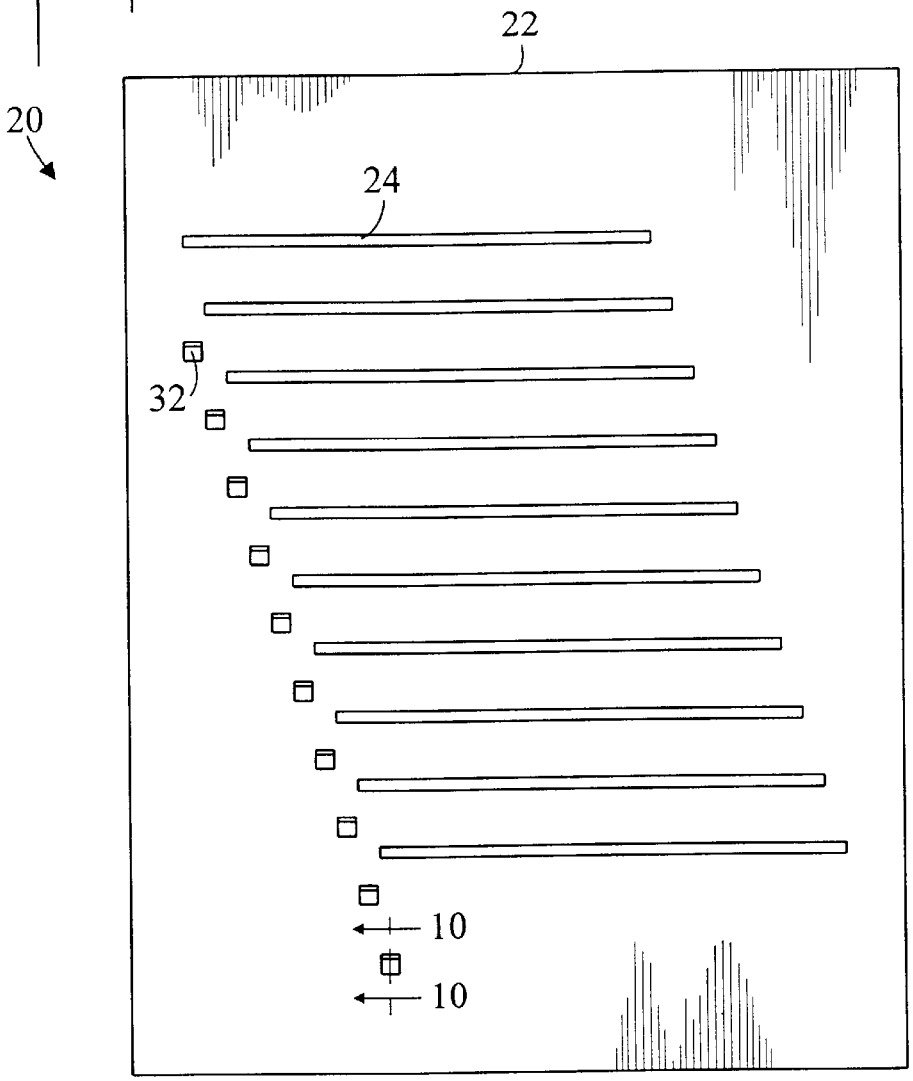
FIG. 8 is a front elevation view of the first and second sheets combined to form a card storage and display device in accordance with the present invention.
Figure 9:
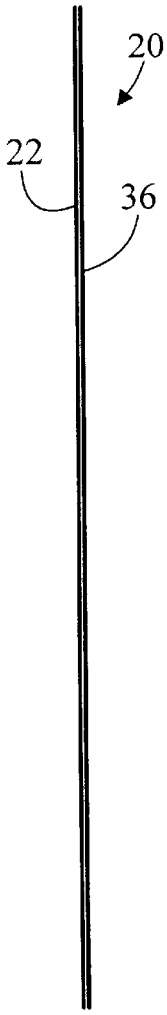
FIG. 9 is a side elevation view of the card storage and display device.
Figure 10:
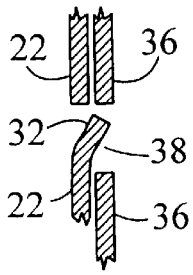
FIG. 10 is an enlarged cross-sectional view along the line 10—10 of FIG. 8.

FIGS. 8 and 9 are front and side elevation views respectively of first 22 and second 36 sheets combined to form card storage and display device 20. When first sheet 22 and second sheet 36 are aligned, tabs 32 occupy openings 38 as is illustrated in FIG. 10. In a preferred embodiment first 22 and second 36 sheets are connected together by either an adhesive or by a mechanical holder such as staples. The connection is arranged such that it does not interfere with sliding a card 500 into a slit 24.

Figure 11:
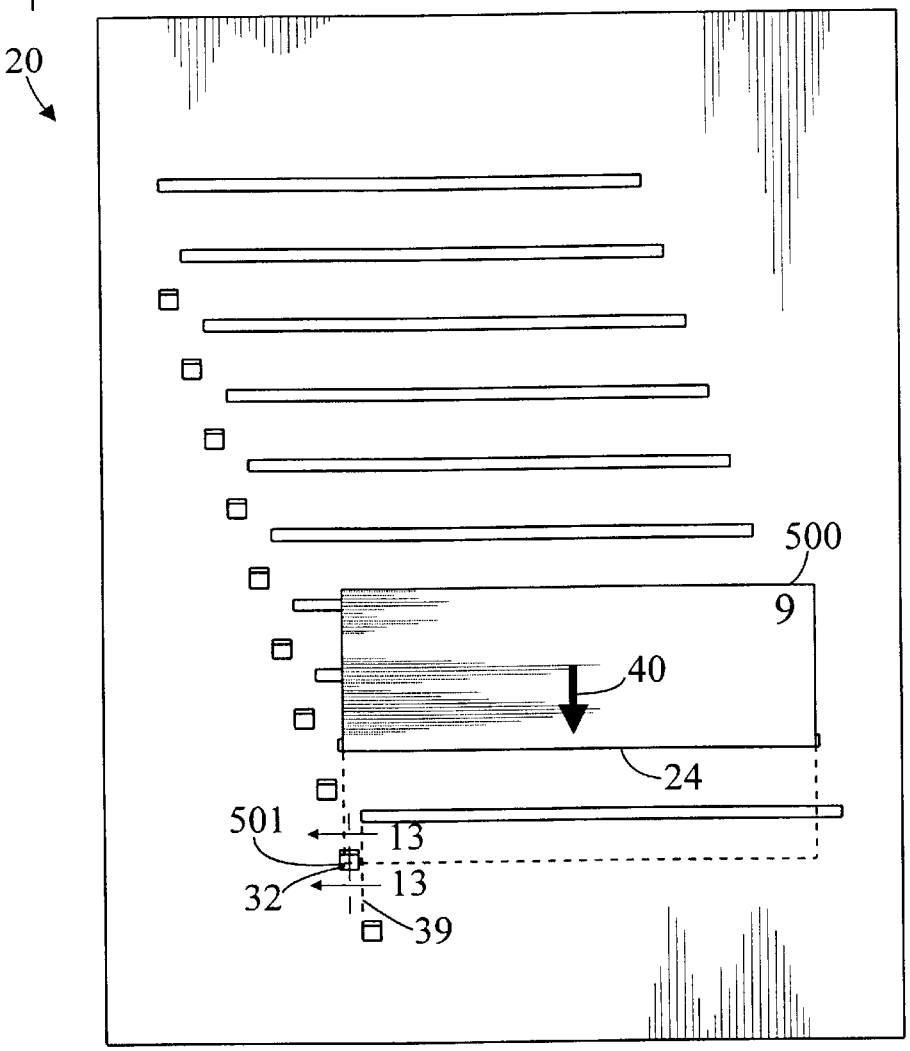
FIG. 11 is a front elevation view of the card storage and display device with a card inserted therein.
Figure 12:
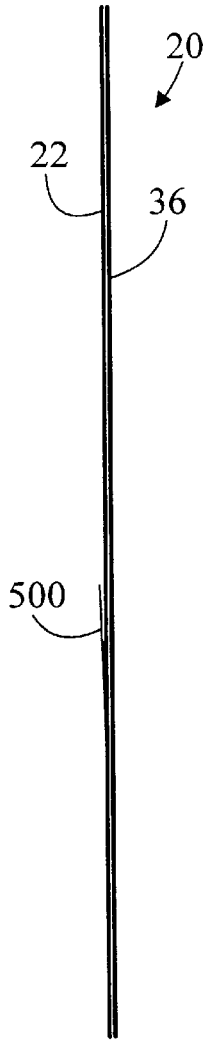
FIG. 12 is a side elevation view of the card storage and display device and inserted card.

FIGS. 11 and 12 are front and side elevation views respectively of card storage and display device 20 with a card 500 inserted therein. When card 500 is inserted into slit 24 in direction 40, lower corner 501 of card 500 abuts tab 32 and is stopped thereby. An upper portion of card 500 remains displayed above slit 24. It is noted that each tab 32 is longitudinally aligned with each corresponding slit 24 so that a card 500 inserted in a next lower slit 24 will not abut the tab 32 as is shown by line 39 in FIG. 11. It is also noted that slit 24 is only slightly longer than card 500 so that the edge of card 500 will remain substantially perpendicular to slit 24 when card 500 is inserted into slit 24.

Figure 13:
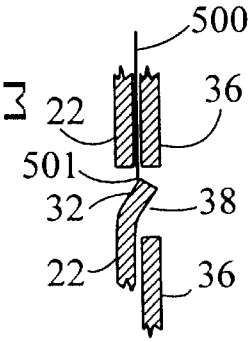
FIG. 13 is an enlarged cross sectional view along the line 13—13 of FIG. 11.

FIG. 13 is an enlarged cross-sectional view along the line 13—13 of FIG. 11. It is noted that bottom corner 501 of card 500 abuts tab 32 and is therefore stopped.

Figure 14:
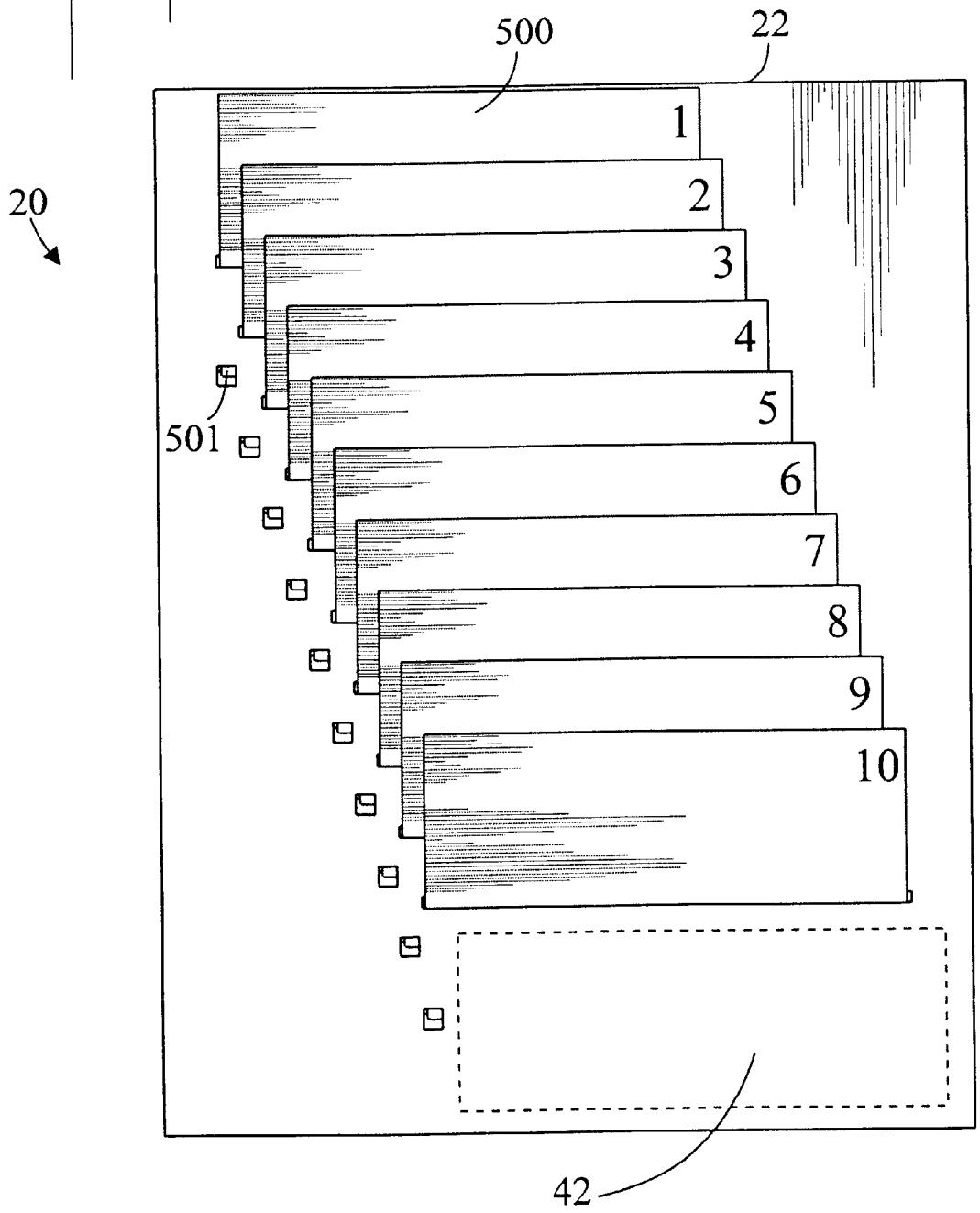
FIG. 14 is a front elevation view of the card storage and display device with a plurality of cards inserted therein; and, FIG. 15 is a top plan view of a second embodiment of the card storage and display device.

FIG. 14 is a front elevation view of card storage and display device 20 with a plurality of cards 500 inserted therein. First sheet 22 includes a space 42 reserved for indicia, such as a label, which is representative of the contents of the card storage and display device 20.

Figure 15:
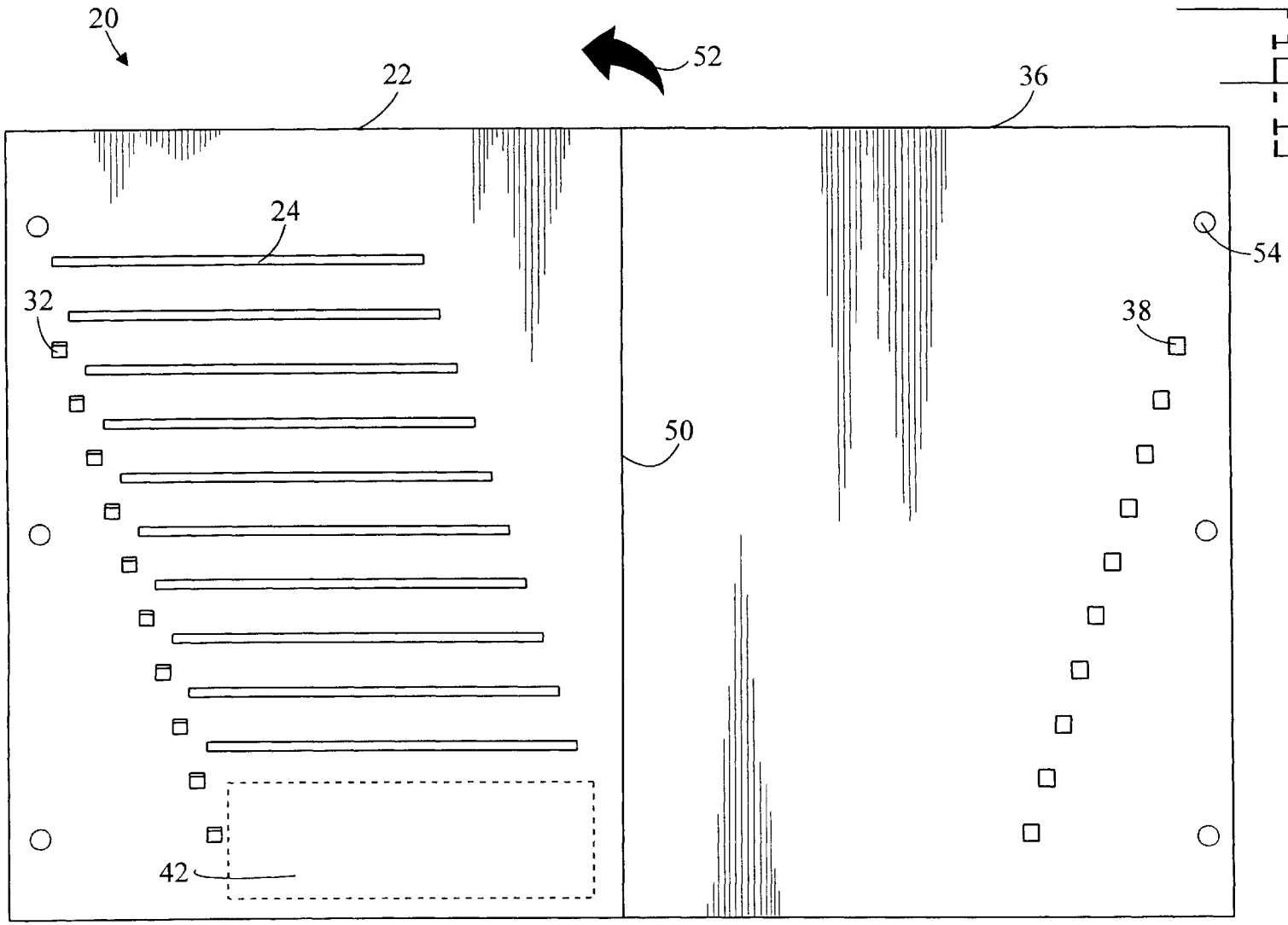

FIG. 15 is a top plan view of a second embodiment of the card storage and display device 20. First sheet 22 and second sheet 36 are connected by a fold line 50. Notice that the openings 38 on second sheet 36 are reversed so that when card storage and display device 20 is folded in direction 52 about fold line 50, tabs 32 align with and occupy openings 38. In this embodiment, device 20 has holes 54 to accommodate installation in a three ring binder.

In a preferred embodiment first 22 and second 36 sheets are fabricated from semi-rigid material, such as paper, cardboard, fiberboard, of a polymer.

In terms of use, a card 500 is inserted into a slit 24 and pushed down until the bottom corner 501 engages corresponding tab 32 and is therefore stopped.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. A storage and display device for a plurality of cards, comprising:

a first sheet having a plurality of spaced apart parallel slits arranged in staggered off-set relationship, each said slit having a first end;

said first sheet having a front side and an opposite back side;

said first sheet having a corresponding plurality of tabs arranged in staggered off-set relationship, each said tab cooperating with one said slit to form a slit/tab pair wherein said tab is disposed a predetermined distance below said first end of said slit;

said tabs outwardly projecting from said back side; and, a second sheet having a corresponding plurality of openings, said openings disposed so that when said first sheet is placed on top of said second sheet and aligned therewith, said plurality of tabs resided in said corresponding plurality of openings.

2. A storage and display device according to claim 1 wherein each card has a lower corner, said storage and display device further including:

when a card is inserted into said slit, the lower corner of the card abutting said tab and stopped thereby.

3. A storage and display device according to claim 1, further including:

each said tab longitudinally aligned with each said corresponding slit so that a card inserted into a next lower slit will not abut said tab.

4. A storage and display device according to claim 1, further including:

said first and second sheets fabricated from semi-rigid material.

5. A storage and display device according to claim 4, further including:

said semi-rigid material including one of paper, cardboard, fiberboard, and a polymer.

6. A storage and display device according to claim 1, further including:

said first and second sheets connected by one of adhesive and a mechanical holder.

7. A storage and display device according to claim 1, wherein each card has a lower corner, said storage and display device further including:

when a card is inserted into said slit, the lower corner of the card abutting said tab and stopped thereby;

each said tab longitudinally aligned with each said corresponding slit so that a card inserted in a next lower slit will not abut said tab; and, said first and second sheets fabricated from semi-rigid material.

8. A method of storing and displaying cards, comprising:

providing a storage and display device including a first sheet having a plurality of spaced apart parallel slits arranged in staggered offset relationship, said first sheet having a front side and an opposite back side, said first sheet having a corresponding plurality of tabs arranged in staggered off-set relationship, each said tab cooperating with one said slit to form a slit/tab pair wherein said tab is disposed a predetermined distance below said first end of said slit, said tabs outwardly projecting from said back side, and a second sheet having a corresponding plurality of openings, said openings disposed so that when said first sheet is placed on top of said second sheet, said plurality of tabs resided in said corresponding plurality of openings;

providing at least one card having a lower corner;

inserting the card into said slit so that the lower corner of the card abuts said tab and is stopped thereby.

* * * * *